US009284085B2

(12) United States Patent
Pace

(10) Patent No.: US 9,284,085 B2
(45) Date of Patent: Mar. 15, 2016

(54) DEVICE FOR HOLDING AND HANDLING ROLLS OF WRAPPING MATERIAL

(71) Applicant: Danehe, LLC, Atlanta, GA (US)

(72) Inventor: Jeffrey Hugh Pace, Atlanta, GA (US)

(73) Assignee: Danehe, LLC, Atlanta, GA (US)

( * ) Notice: Subject to any disclaimer, the term of this patent is extended or adjusted under 35 U.S.C. 154(b) by 221 days.

(21) Appl. No.: 14/062,978

(22) Filed: Oct. 25, 2013

(65) Prior Publication Data

US 2014/0116004 A1 May 1, 2014

Related U.S. Application Data

(60) Provisional application No. 61/718,914, filed on Oct. 26, 2012.

(51) Int. Cl.
*B65B 67/08* (2006.01)
*B65H 75/40* (2006.01)

(52) U.S. Cl.
CPC ..... *B65B 67/085* (2013.01); *B65H 75/406* (2013.01); *B65H 2402/412* (2013.01)

(58) Field of Classification Search
CPC A01K 89/003; Y10S 242/902; B65B 67/085; B65H 2402/412; B65H 75/406; B31D 2205/0023
See application file for complete search history.

(56) References Cited

U.S. PATENT DOCUMENTS 1,226,928 A 5/1917 Updike
1,364,259 A 1/1921 Eaton ..... B65H 59/04 242/129.8
1,884,183 A * 10/1932 Pearson ..... H01F 41/0679 242/129.51
2,492,515 A 12/1949 Beard ..... A01K 89/003 242/388.6
2,848,778 A 8/1958 Plummer, Sr. ..... A01K 89/003 24/135 N
3,026,059 A 3/1962 Dennler ..... A01K 89/003 242/396.9
3,685,761 A 8/1972 Zelinski ..... A01K 89/003 242/129.7
3,951,354 A 4/1976 Bagby ..... A01K 89/003 242/129.8
3,973,741 A 8/1976 Dean ..... A01K 89/003 242/395
4,102,513 A * 7/1978 Guard ..... B65B 67/085 156/577
4,166,589 A * 9/1979 Hoover ..... B65B 67/085 156/577
4,179,081 A 12/1979 Parry
4,248,392 A 2/1981 Parry
4,360,172 A 11/1982 Cope ..... A01K 89/003 242/134
4,477,037 A 10/1984 Goldstein
4,484,717 A 11/1984 Goldstein
4,522,348 A 6/1985 Strout (Continued)

*Primary Examiner* — Emmanuel M Marcelo
*Assistant Examiner* — Michael Gallion
(74) *Attorney, Agent, or Firm* — Laurence P. Colton; Smith Risley Tempel Santos LLC

(57) ABSTRACT

A device for holding and handling a roll of wrapping material having a tube handle, a tube extension adjustable connected to the tub handle, a top end cap on the tube handle, a bottom end cap on the tube extension, and a tensioning means, wherein the bottom end cap releasably holds the roll of wrapping material on the tube extension against the tensioning means, whereby the tensioning means is adjustable while the device is in use applying wrapping material to an item to be wrapped.

18 Claims, 16 Drawing Sheets

(56) References Cited

U.S. PATENT DOCUMENTS 4,535,951 A * 8/1985 Riemenschneider, III ..... B65B 67/085 242/423.2
4,600,163 A 7/1986 Hummel ..... B65B 67/085 242/422.1
4,714,211 A 12/1987 Hwang
4,950,147 A * 8/1990 Willard ..... A21C 3/10 425/185
5,218,779 A 6/1993 Morgan ..... A01K 89/003 242/423.2
5,277,350 A 1/1994 Thornbury, Jr. ..... A63H 27/002 242/588.2
5,664,739 A 9/1997 Black ..... B65H 75/406 242/588.2
5,673,542 A 10/1997 Vartanian
5,749,539 A 5/1998 Ratzel ..... B31D 5/0047 242/588.2
5,868,334 A * 2/1999 Cedillo ..... B65H 75/406 206/420
5,871,167 A * 2/1999 Beauviala ..... G03G 17/265 242/345.1
5,927,635 A * 7/1999 Black ..... B65H 75/406 242/395
6,015,111 A * 1/2000 Berke ..... A01K 89/003 242/250
6,027,069 A * 2/2000 Huang ..... B65B 67/085 242/588.2
6,224,011 B1 * 5/2001 Gavaza, III ..... A01K 89/003 242/400
6,739,542 B1 * 5/2004 Prina ..... B65B 67/085 242/423.2
7,357,349 B1 * 4/2008 Huang ..... B65B 67/085 242/405.3
7,543,426 B1 * 6/2009 Phero ..... B65B 67/08 156/574
8,925,855 B1 * 1/2015 Wu et al. ..... A01K 89/003 242/596.3
2007/0079578 A1 * 4/2007 Yu Chen ..... B65B 67/085 53/592
2007/0151208 A1 * 7/2007 Huang ..... B65B 67/085 53/390
2008/0072543 A1 * 3/2008 Watson ..... B65B 67/085 53/441
2015/0136895 A1 * 5/2015 Choi ..... B65B 67/085 242/588

* cited by examiner

DEVICE FOR HOLDING AND HANDLING ROLLS OF WRAPPING MATERIAL

STATEMENT OF RELATED APPLICATIONS

This patent application is based on and claims the benefit of U.S. Provisional Patent Application No. 61/718,914 having a filing date of 26 Oct. 2012.

BACKGROUND OF THE INVENTION

1. Technical Field

The present invention generally is in the field of devices for applying wrapping material and more specifically is in the field of devices for applying stretch wrap material to goods and pallets.

2. Prior Art

Devices for holding and handling rolls of material, and for applying wrapping and other materials, are known. Several of these devices are the subject of U.S. Pat. Nos. 7,543,426, 5,673,542, 4,714,211, 4,535,951, 4,522,348, 4,484,717, 4,477,037, 4,248,392, 4,179,081, 4,166,589, 4,102,513, and 1,226,928.

Devices for tensioning rolls of material are known. One of these devices is the subject of U.S. Pat. No. 1,364,259.

Applicant believes that there is a need for a device for applying stretch wrap to a pallet without requiring the user to bend at the waist. Applicant additionally believes that there is a need for a device that offers users a superior way to apply stretch film. Applicant further believes that there is a need for a material wrapping device with a tensioning system designed so that a user can control the tension of the film in a consistent but individualized manner. Applicant also believes that there is a need for a device that allows the user to load rolls of material from the bottom of the device without having to disassemble the device each time a roll of material needs to be replaced. It is to these needs and others that the present invention is directed

BRIEF SUMMARY OF THE INVENTION

Briefly, the present invention is an innovative device for applying stretch wrap to a pallet without requiring the user to bend at the waist. A focus of the invention is an evolutionary new wrap dispenser that addresses unmet needs and offers potential customers a superior way to apply stretch film.

The invention comprises a tube extension, a handle assembly with a grip and tensioning system assembly, and an end cap assembly. A roll of wrapping material is placed on the tube extension where it can be rotated for applying the wrapping material to the item(s) to be wrapped, such as goods or pallets. The end cap assembly comprises a means for retaining the end cap assembly on the tube extension so as to hold the roll of wrapping material on the tube extension. The end cap assembly also comprises or is composed of a material of sufficient strength and wear-resistance to contact the floor as the device is moved about the item(s) to be wrapped. The tube extension is attached to the handle assembly. A roll of wrapping material is slid over the tube extension from the direction of the end cap assembly until the roll of wrapping material contacts the grip and tensioning system assembly. The end cap assembly is attached to the tube assembly to hold the roll of wrapping material on the device in a position where the roll of wrapping material maintains a position against the grip and tensioning system assembly.

One feature that makes the present invention unique is the tensioning system, which is designed so that the user can control the tension of the film in a consistent but individualized manner. Different users require different tension for applying wrapping material, such as stretch film, and the present invention is structured to allow for a user-defined tension setting that can be changed on the fly, such as, for example, while the device is being used and/or without having to disassemble the device. The tensioning system allows the user to turn a tension wheel on the unit that is threaded on the tube handle that tightens and loosens the tension of the roll of wrapping material. This tension can be adjusted on the fly as the roll of wrapping material necessitates more or less tension. This is unique in that this feature uses a drag effect instead of a constant use brake. The user can turn the tension wheel to a desired tension and then leave it there, which is a main difference relative to the prior art as the prior art requires the user to apply a constant brake action to control tension.

The present invention also has a quarter turn end cap to allow the user to load film from the bottom of the device without having to disassemble the device each time a roll of film needs to be replaced, as the quarter turn end cap can be easily removed and replaced when changing a roll of film. This allows for a much more productive worker who spends considerably less time replacing rolls.

In use, the user grasps the device by the handle tube grip (on top) and the grip handle (generally centrally), with the roll of wrapping below the grip handle and above the end cap assembly. The device can be used in any orientation, such as vertically, horizontally, angled, or with the tube grip below the end cap assembly. The wrapping material, such as stretch wrap, is placed against the item to be wrapped, such as goods on a pallet. The device then is walked around the pallet thus unwinding the stretch wrap around the goods on the pallet. Once the item to be wrapped is wrapped a sufficient amount, the wrapping material is cut. If the roll of wrapping material runs out of wrapping material, the empty roll of wrapping material can be removed from the device and replaced with a new roll of wrapping material.

These features, and other features and advantages of the present invention will become more apparent to those of ordinary skill in the relevant art when the following detailed description of the preferred embodiments is read in conjunction with the appended drawings in which like reference numerals represent like components throughout the several views

BRIEF DESCRIPTION OF THE DRAWINGS

FIG. 12C.

DESCRIPTION OF PREFERRED EMBODIMENTS

Figure 1:
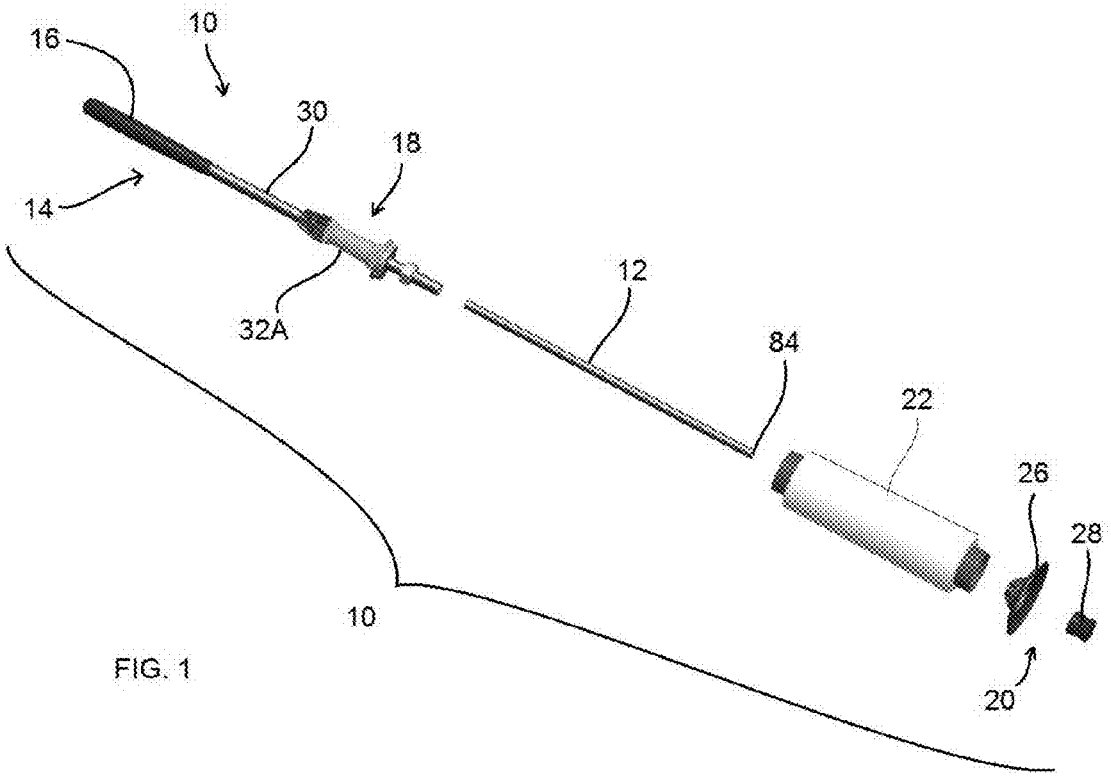
FIG. 1 is an exploded view of the present invention.

FIG. 1 is an exploded view of the present invention. The inventive device 10 comprises a tube extension 12, a handle assembly 14 with a hand grip 16, a tensioning system assembly 18, and an end cap assembly 20. A roll of wrapping material 22 is placed on the tube extension 12 where it can be rotated for applying the wrapping material 22 to the item(s) to be wrapped, such as goods or pallets 24. The end cap assembly 20 comprises an end cap 26 and a means for retaining the end cap 26 on the tube extension 12, such as a locking knob or quarter turn knob 28, which cooperate so as to hold the roll of wrapping material 22 on the tube extension 12. The end cap assembly 20 also comprises or is composed of a material of sufficient strength and wear-resistance to contact the floor as the device 10 is moved about the item(s) to be wrapped.

The tube extension 12 is releasably and adjustably attached to the handle assembly 14 as disclosed in greater detail in connection with the description of FIG. 4. The roll of wrapping material 22 is slid over the tube extension 12 from the direction of the location of the end cap assembly 20 until the roll of wrapping material 22 contacts the tensioning system assembly 18. More specifically, the end cap assembly 20 is removed from the tube extension 18 such that an empty or unwanted roll of wrapping material 22 can be removed from or a full or desired roll of wrapping material 22 can be placed onto the tube extension 12. The end cap assembly 20 then is attached to the tube extension 12 to hold the roll of wrapping material 22 on the device 10 in a position where the roll of wrapping material 22 maintains a position against the tensioning system assembly 18.

Figures 2A, 2B:
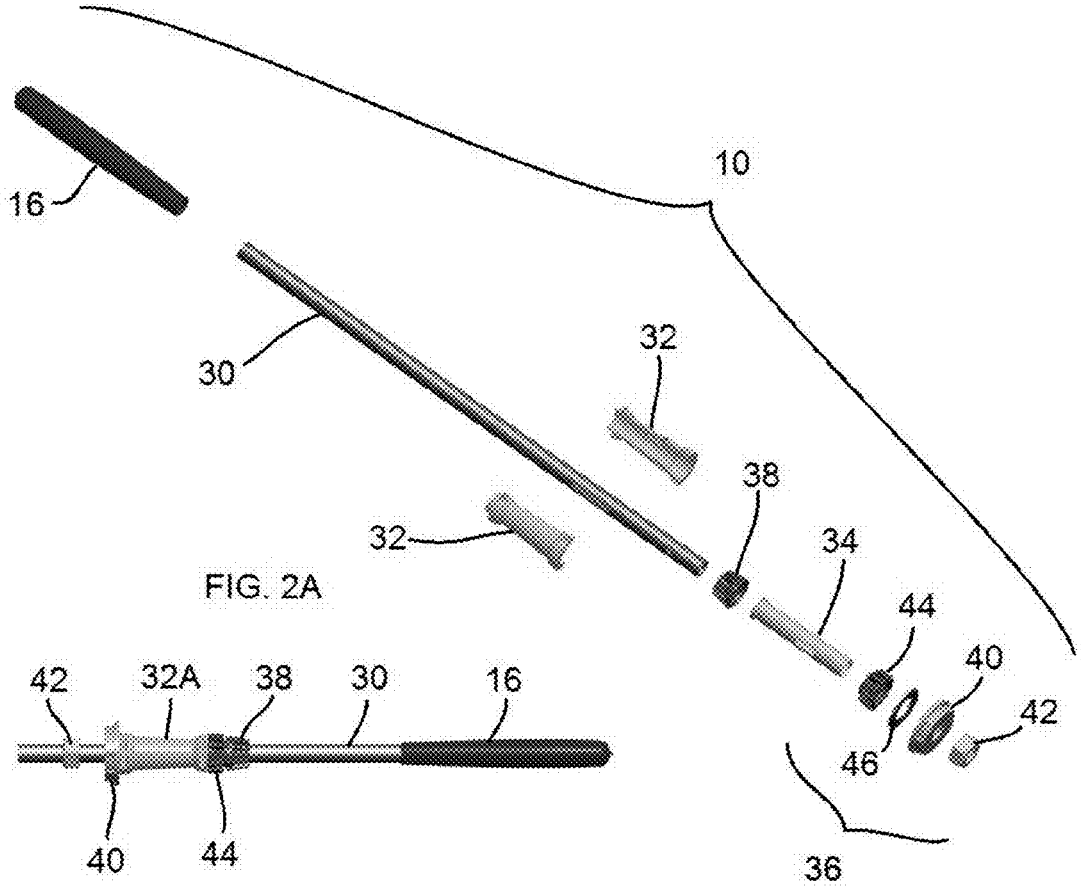
FIG. 2A is an exploded view of a handle and tensioning system of the present invention.
FIG. 2B is a side view of the handle and tensioning system of FIG. 2A.

FIG. 2 are views of a handle assembly 14 and a tensioning system assembly 18 of the present invention shown in more detail. FIG. 2A is an exploded view of a handle assembly 14 and a tensioning system assembly 18 of the present invention. FIG. 2B is a side view of the handle assembly 14 and a tensioning system assembly 18 of FIG. 2A shown assembled together.

The handle assembly 14 comprises a hand grip 16 on a tube handle 30. The tensioning system assembly 18 comprises grip halves 32, a tube inner grip 34, a tensioning means 36, an optional fine adjust tensioning means 38, a top end cap 40, and a means for retaining the various components, such as nut 42, on a tube handle 30. The grip halves 32 and the tube inner grip 34 are attached to the tube handle 30. The tensioning system assembly 18 can be actuated to move and hold the grip halves 32 and tube inner grip 34 against a first end of the roll of wrapping material 22 at a desired tension by causing the top end cap 40 to press against the roll of wrapping material 22. The top end cap 40 can be designed to fit snugly inside the tube holding the wrapping material 22, which can be a cardboard tube or a plastic tube, for example.

The actuation of the tensioning system assembly 18 allows the user to turn a tension wheel 44 on the device 10 that is threaded on the tube handle 30 that tightens and loosens the tension of the roll of wrapping material 22. For example, after the roll of wrapping material 22 has been placed on the device 10 and the end cap assembly 20 replaced on the tube extension 12, the top end of the roll of wrapping material 22 preferably contacts the top end cap 40. By turning the tension wheel 44, tension wheel 44 presses against grip halves, forcing grip halves 32 against top end cap 40, which in turn is in contact with the roll of wrapping material 22. This causes pressure against the roll of wrapping material 20. Less pressure allows the roll of wrapping material 22 to turn more freely, and more pressure allows the roll of wrapping material 22 to turn less freely. A bearing 46 can be placed between grip halves 32 and top end cap 40 to help alleviate the effects friction may have between grip halves 32 and top end cap 40.

The pressure, or tension, between top end cap 40 and the roll of wrapping material 22 can be adjusted on the fly as the roll of wrapping material 22 necessitates more or less tension. For example, for certain types of wrapping material 22, or for certain types of users who may prefer more or less tension on the roll of wrapping material 22, the tension can be adjusted as desired or needed. This is unique in that this feature uses a drag effect instead of a constant use brake. The user can turn the tension wheel 44 to a desired tension and then leave it there, which is the main difference to the prior art as the prior art requires the user to apply a constant brake action to control tension.

Figure 3A:
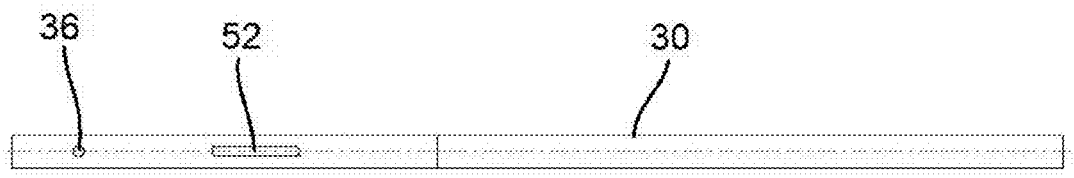
FIG. 3A is a schematic top view of a tube handle of the present invention.
Figure 3B:
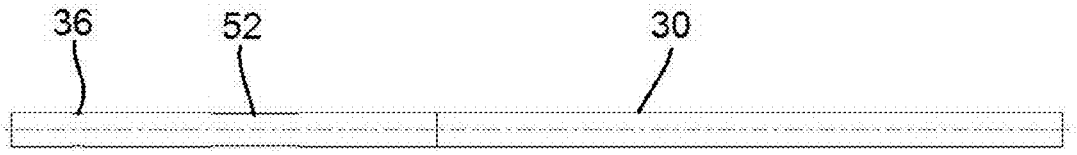
FIG. 3B is a schematic side view of the tube handle of FIG. 3A.
Figure 3C:
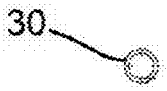
FIG. 3C is a schematic end view of the tube handle of FIG. 3A.

FIG. 3 are a schematic top view, side view, and end view of a tube handle 30 of the present invention. FIG. 3A is a schematic top view of a tube handle 30 of the present invention. FIG. 3B is a schematic side view of the tube handle 30 of FIG. 3A. FIG. 3C is a schematic end view of the tube handle 30 of FIG. 3A.

The tube handle 30 is a hollow tube on which the handle grip 16 and the tensioning system assembly 18 are located. The handle grip 16 is located proximal to a first or top end and is used by the user for grasping the device 10. The tensioning system assembly 18 is located proximal to a second or bottom end and is used by the user for imparting a resistance to the roll of wrapping material 22 to allow it to spin about the tube extension 12 more or less easily.

Tube handle 30 preferably comprises at least one guide slot 52 located coaxially proximal to the second or bottom end of the tube handle 30. Guide slot cooperates with guide tab 50 on grip halves 32 to help control and guide grip halves 32 in conjunction with tube inner grip 34, as discussed in more detail in connection with FIG. 9. Tube handle 30 also preferably comprises an adjustment means 36 tube extension 12 to tube handle 30. Preferably, adjustment means 36 allows tube extension 12 to be releasably and adjustably secured to tube handle 30. Illustrative examples of adjustment means 36 includes pins, tabs, buttons, spring clips, spring tabs, and other known devices for allowing nesting telescoping tubes to be releasably and adjustably secured to one another.

Figure 4A:
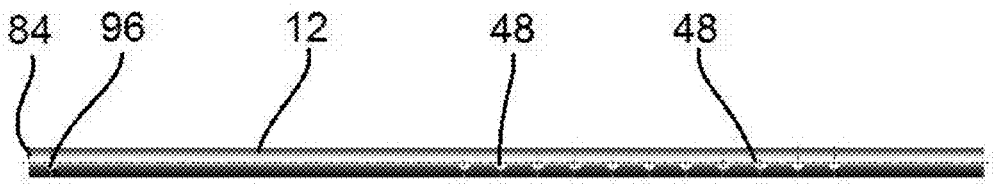
FIG. 4A is a top view of a tube extension of the present invention.
Figure 4B:
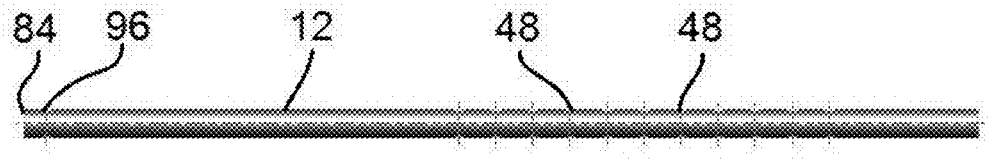
FIG. 4B is a side view of the tube extension of FIG. 4A.
Figure 4C:
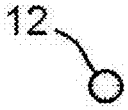
FIG. 4C is an end view of the tube extension of FIG. 4A.

FIG. 4 are a top view, side view, and end view of a tube extension 12 of the present invention. FIG. 4A is a top view of a tube extension 12 of the present invention. FIG. 4B is a side view of the tube extension 12 of FIG. 4A. FIG. 4C is an end view of the tube extension 12 of FIG. 4A. Tube extension 12 can be a hollow tube or preferably is a solid rod.

The tube extension 12 is a tube or rod on which the roll of wrapping material 22 is rotatably placed and on which the end cap 26 is releasably attached. The tube extension 12 has an outer diameter that can slidably fit within the interior of the tube handle 30. Thus, the tube extension 12 can create an adjustable length that is adjustable relative to the length of the roll of wrapping material 22. For example, tube extension 12 can cooperate in a telescoping relationship with tube handle 30 so as to fit various sized rolls of wrapping material 22. For a shorter roll of wrapping material 22, the tube extension 12 can be slid further into the tube handle 30 such that a first end of the roll of wrapping material 22 can contact the top end cap 40 and the tensioning system assembly 18 and a second end of the roll of wrapping material 22 can contact the bottom end cap 26 and the end cap assembly 20.

Tube extension 12 has a series of adjustment holes 48 that cooperate with an adjustment means 36 on tube handle 30. Thus, tube extension 12 can be moved along tube handle 30 to a desired place corresponding approximately to the length of the roll of wrapping material 22, and adjustment means 36 can cooperate with one of the adjustment holes 48 to secure tube extension 12 at the desired place on tube handle 30. Adjustment means 36 can be, for example, a spring-loaded button, the button having a size that cooperates with the size of the adjustment holes 48, or pins that fit through a hole in handle tube 30 and through an adjustment hole 48 on tube extension.

Figure 5A:
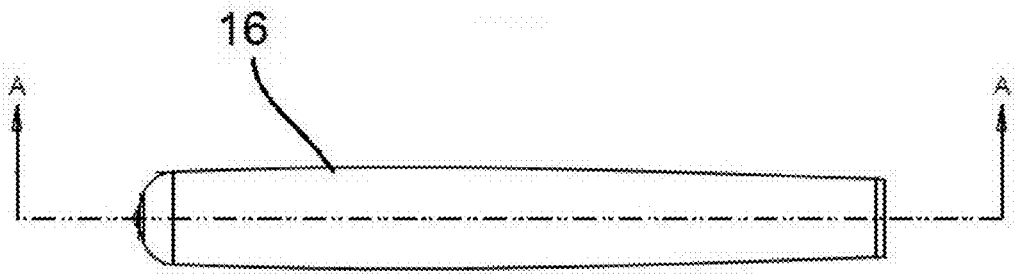
FIG. 5A is a schematic top view of a handle tube of the present invention.
Figure 5B:
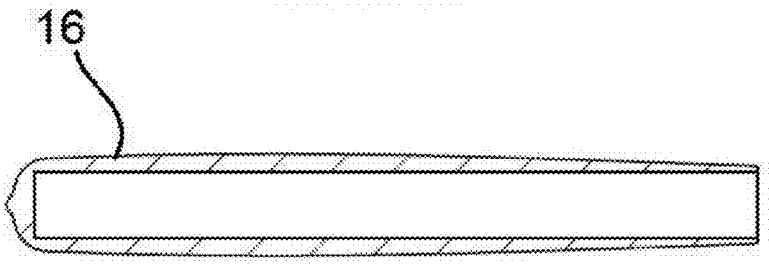
FIG. 5B is a schematic cross-sectional side view of the handle tube of FIG. 5A along section line A-A of FIG. 5A.
Figure 5C:
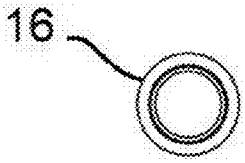
FIG. 5C is a schematic end view of the handle tube of FIG. 5A.
Figure 6A:
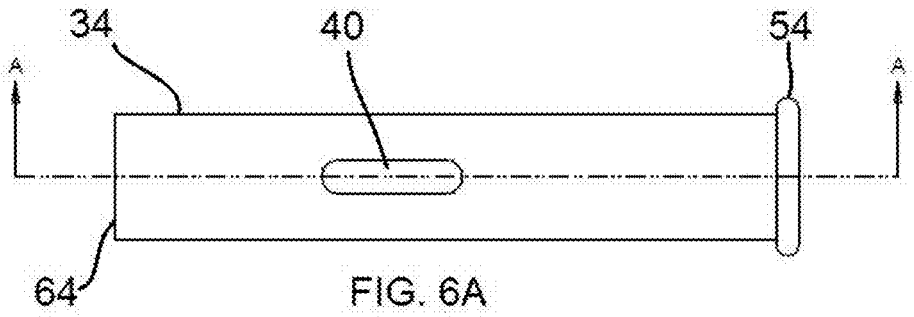
FIG. 6A is a schematic top view of a tube inner grip of the present invention.
Figure 6B:
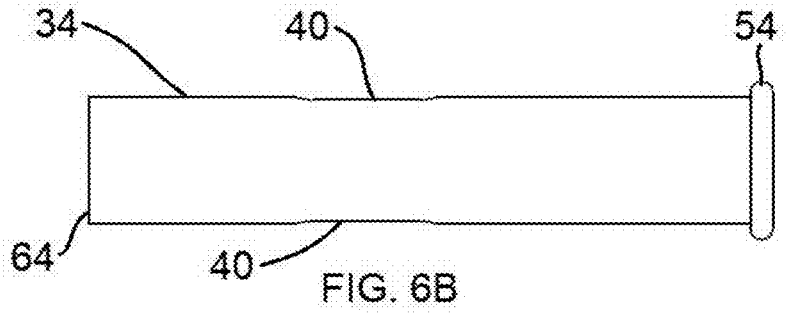
FIG. 6B is a schematic side view of the tube inner grip of FIG. 6A.
Figure 6C:
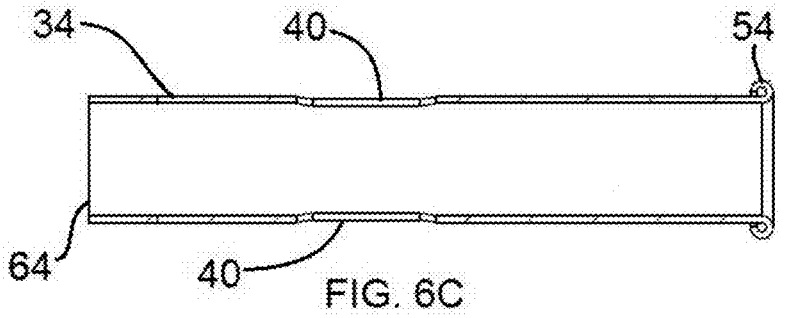
FIG. 6C is a schematic cross-sectional side view of the tube inner grip of FIG. 6A along section line A-A of FIG. 6A.
Figure 6D:
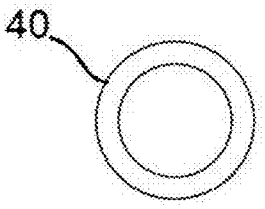
FIG. 6D is a schematic end view of the tube inner grip of FIG. 6A.
Figure 7A:
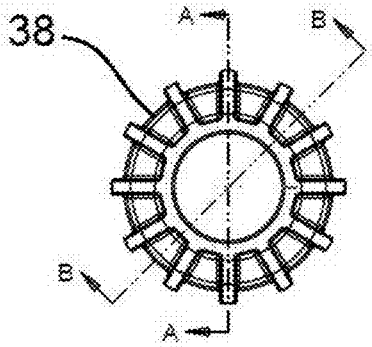
FIG. 7A is a top view of a fine adjust tensioning wheel of the present invention.
Figure 7D:
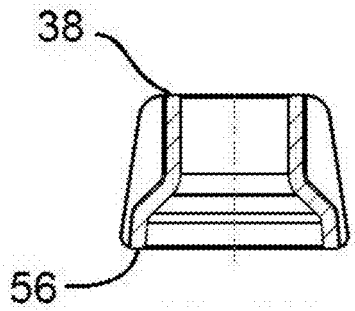
FIG. 7D is a cross-sectional left side view of the fine adjust tensioning wheel of FIG. 7A along section line B-B of FIG. 7A.
Figure 7B:
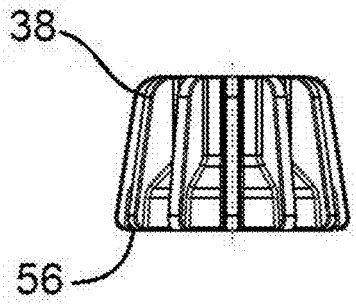
FIG. 7B is a side view of the fine adjust tensioning wheel of FIG. 7A.
Figure 7E:
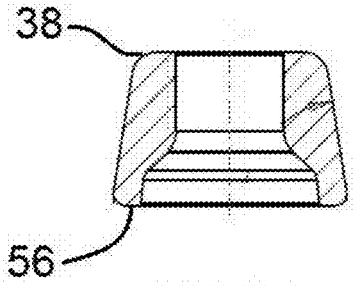
FIG. 7E is a cross-sectional right side view of the fine adjust tensioning wheel of FIG. 7A along section line A-A of FIG. 7A.
Figure 7C:
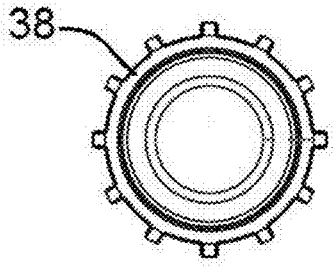
FIG. 7C is a bottom view of the fine adjust tensioning wheel of FIG. 7A.
Figure 8A:
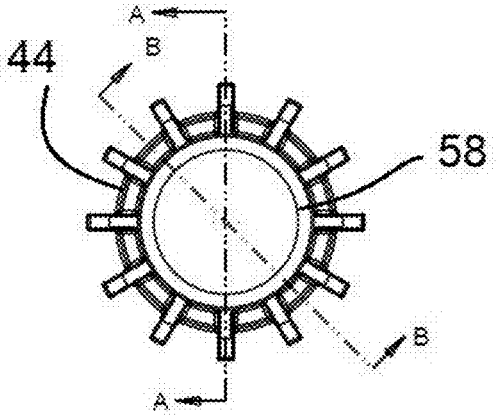
FIG. 8A is a top view of a tensioning wheel of the present invention.
Figure 8D:
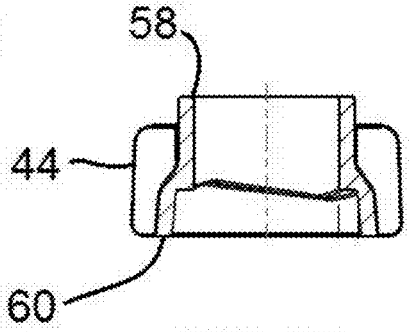
FIG. 8D is a cross-sectional left side view of the tensioning wheel of FIG. 8A along section line B-B of FIG. 8A.
Figure 8B:
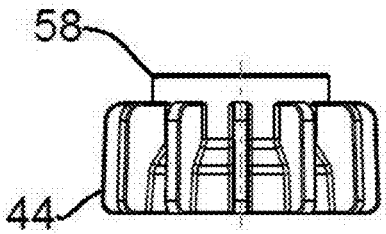
FIG. 8B is a side view of the tensioning wheel of FIG. 8A.
Figure 8E:
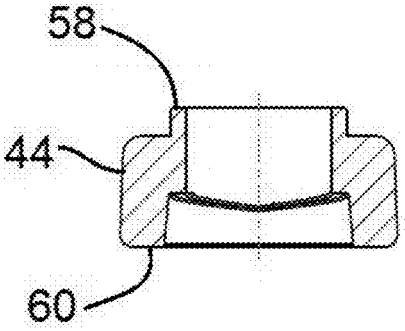
FIG. 8E is a cross-sectional right side view of the tensioning wheel of FIG. 8A along section line A-A of FIG. 8A.
Figure 8C:
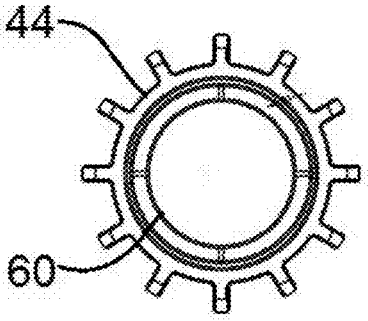
FIG. 8C is a bottom view of the tensioning wheel of FIG. 8A.
Figure 9A:
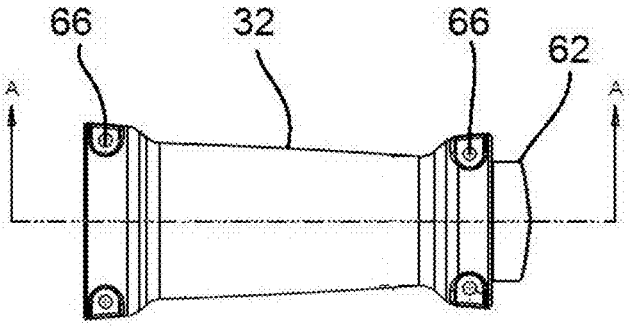
FIG. 9A is a top view of a grip half 32 of the present invention.
Figure 9B:
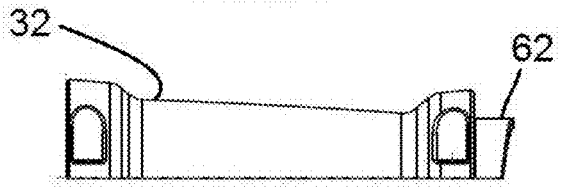
FIG. 9B is a side view of the grip half of FIG. 9A.
Figure 9C:
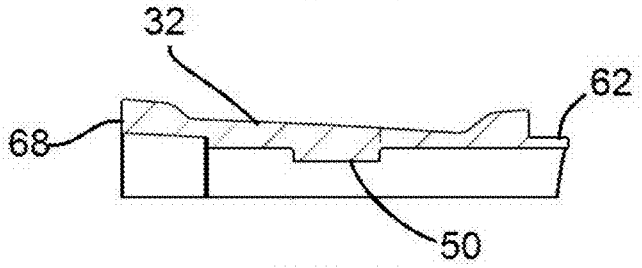
FIG. 9C is a cross-sectional side view of the grip half of FIG. 9A along section line A-A of FIG. 9A.
Figure 9D:
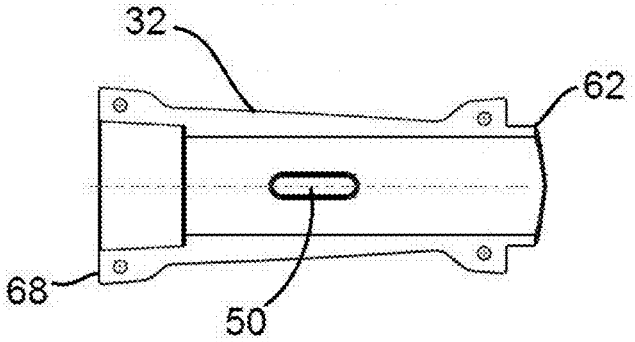
FIG. 9D is a bottom view of the grip half of FIG. 9A.
Figure 9E:
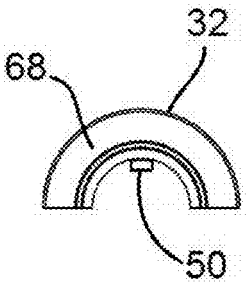
FIG. 9E is a left end view of the grip handle of FIG. 9A.
Figure 9F:
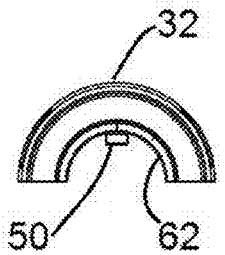
FIG. 9F is a right end view of the grip half of FIG. 9A.
Figure 10A:
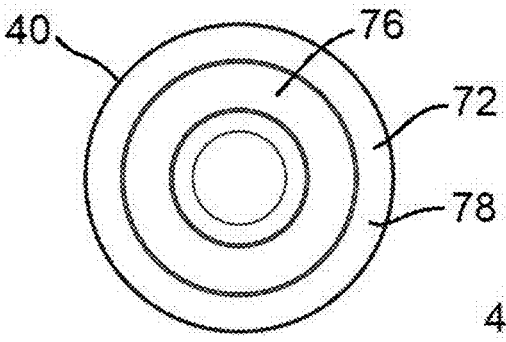
FIG. 10A is a top view of a roll top end cap of the present invention.
Figure 10D:
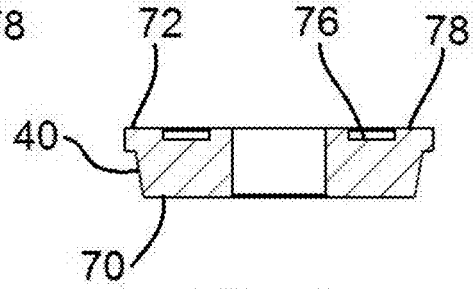
FIG. 10D is a cross-sectional left side view of the roll top end cap of FIG. 10A along section line B-B of FIG. 10C.
Figure 10B:
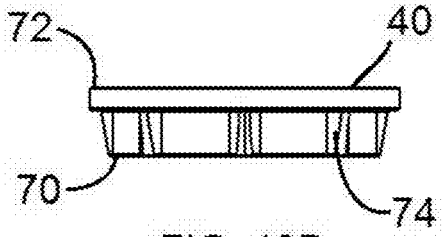
FIG. 10B is a side view of the roll top end cap of FIG. 10A.
Figure 10E:
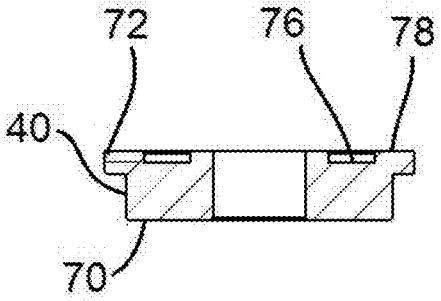
FIG. 10E is a cross-sectional right side view of the roll top end cap of FIG. 10A along section line A-A of FIG. 10C.
Figure 10C:
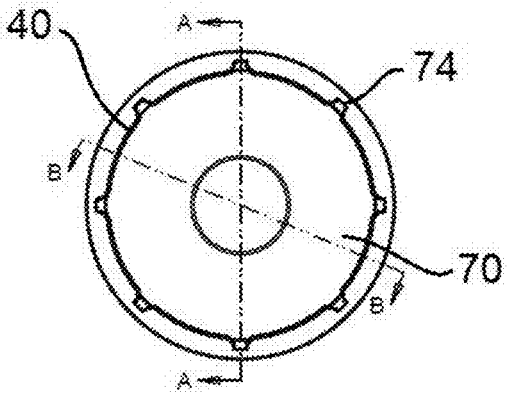
FIG. 10C is a bottom view of the roll top end cap of FIG. 10A.
Figure 11A:
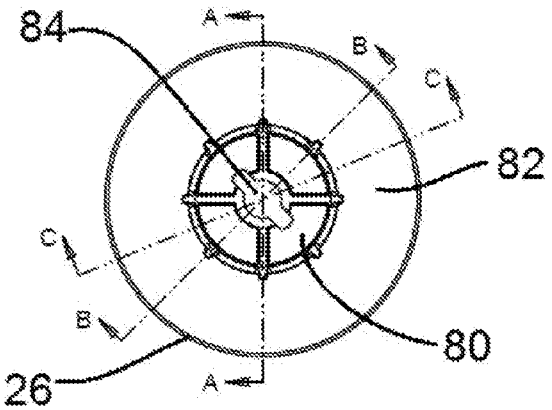
FIG. 11A is a top view of a roll bottom end cap of the present invention.
Figure 11D:
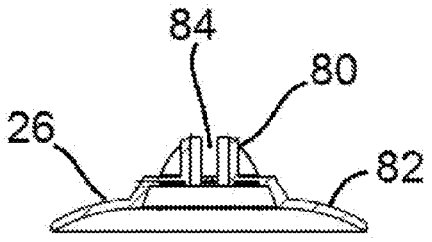
FIG. 11D is a cross-sectional left side view of the roll bottom end cap of FIG. 11A along section line B-B of FIG. 11A.
Figure 11B:
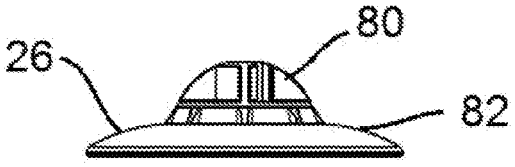
FIG. 11B is a side view of the roll bottom end cap of FIG. 11A.
Figure 11E:
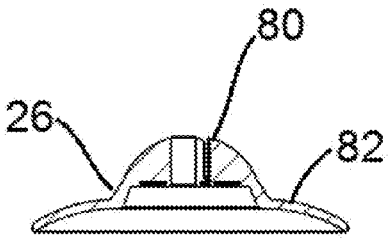
FIG. 11E is a cross-sectional right side view of the roll bottom end cap of FIG. 11A along section line A-A of FIG. 11A.
Figure 11C:
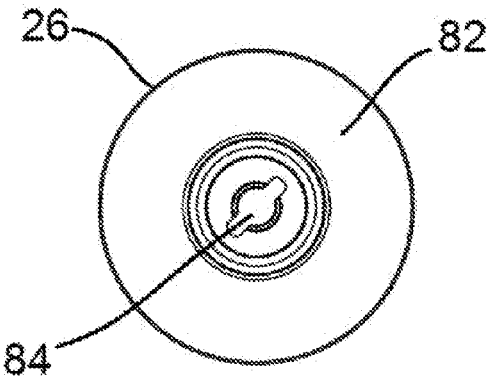
FIG. 11C is a bottom view of the roll bottom end cap of FIG. 11A.
Figure 11F:
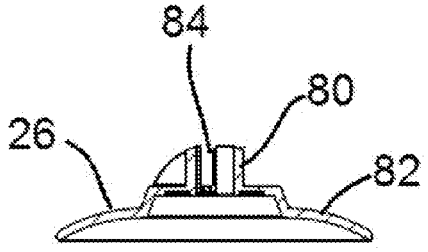
FIG. 11F is a cross-sectional right side view of a roll bottom end cap of FIG. 11A along section line C-C of FIG. 11A.

FIG. 5 are a schematic top view, cross-sectional side view, and end view of a handle grip 16 of the present invention. FIG. 5A is a schematic top view of a handle grip 16 of the present invention. FIG. 5B is a schematic cross-sectional side view of the handle grip 16 of FIG. 5A along section line A-A of FIG. 5A. FIG. 5C is a schematic end view of the handle grip 16 of FIG. 5A. Handle grip 16 can be a rubber or plastic component fitting over the first or top end of the tube handle 30 and is primarily to enhance the comfort of the user in holding and operating the device 10.

FIG. 6 are a schematic top view, side view, cross-sectional side view, and end view of a tube inner grip 34 of the present invention. FIG. 6A is a schematic top view of a tube inner grip 34 of the present invention. FIG. 6B is a schematic side view of the tube inner grip 34 of FIG. 6A. FIG. 6C is a schematic cross-sectional side view of the tube inner grip 34 of FIG. 6A along section line A-A of FIG. 6A. FIG. 6D is a schematic end view of the tube inner grip 34 of FIG. 6A.

Tube inner grip 34 slidably fits over tube handle 30 between tensioning wheel 44 and top end cap 40 and is part of the tensioning assembly 18. As tensioning wheel 44 is rotated in the direction to increase tension on the roll of wrapping material 22, tensioning wheel 44 forces tube inner grip 34 towards the roll of wrapping material 22, forcing top end cap 40 against the roll of wrapping material 22, or at least against the core tube of wrapping material 22. As tensioning wheel 44 is rotated in the direction to decrease tension on the roll of wrapping material 22, tensioning wheel 44 releases tube inner grip 34 away from the roll of wrapping material 22, allowing top end cap 40 to move away from the roll of wrapping material 22, or at least away from the core tube of wrapping material 22. Tube inner grip 34 can have enlarged diameters 54 on one or both ends to better cooperate with top end cap 40 and/or tensioning wheel 44.

Tube inner grip 34 also preferably comprises at least one guide slot 40 located coaxially. Guide slot 40 cooperates with guide tab 50 on grip halves 32 to help control and guide tube inner grip 34 in conjunction with grip halves 32. For example, guide tab 50 can extend through guide slot 40 so that grip halves 32 and tube inner grip 34 can act in concert with each other in placing pressure on top end cap 40, thereby placing pressure on and increasing the tension of the roll of wrapping material 22. Guide tab 50 also can extend through guide slot and cooperate with guide slot 52 to further help control and guide tube inner grip 34 in conjunction with grip halves 32, as discussed in more detail in connection with FIG. 9. Tube inner grip 34 is generally coextensive with the sliding grip handle 32A.

FIG. 7 are a top view, side view, bottom view, cross-sectional left side view, and cross-sectional right side view of an optional fine adjust tensioning wheel 38 of the present invention. FIG. 7A is a top view of a fine adjust tensioning wheel 38 of the present invention. FIG. 7B is a side view of the fine adjust tensioning wheel 38 of FIG. 7A. FIG. 7C is a bottom view of the fine adjust tensioning wheel 38 of FIG. 7A. FIG. 7D is a cross-sectional left side view of the fine adjust tensioning wheel 38 of FIG. 7A along section line B-B of FIG. 7A. FIG. 7E is a cross-sectional right side view of the fine adjust tensioning wheel 38 of FIG. 7A along section line A-A of FIG. 7A. Fine adjust tensioning wheel 38 is a generally cylindrical structure located on tube handle 30 and is generally coaxial with tube handle 30.

Fine adjust tensioning wheel 38 can be located on tube handle 30 between top end cap 40 and tube inner grip 34 and sliding grip handle 32A. If necessary or desired, the device 10 can have a fine adjust tensioning wheel 38 in addition to a tensioning wheel 44. Tensioning wheel 44, as disclosed below, can be used to move the tensioning system assembly 18 against the roll of wrapping material 22 a relatively gross amount, and fine adjust tensioning wheel 38 can be used to move the tensioning system assembly 18 against the roll of wrapping material 22 a relatively fine amount for more exact tensioning of the roll of wrapping material 22. For example, by turning the fine adjust tensioning wheel 38, the fine adjust tensioning wheel 38 presses against the tensioning wheel 44, thereby pressing the tensioning wheel 44 against the sliding grip handle 32A and or the tube inner grip 34 an additional incremental amount, thereby forcing the sliding grip handle 32A and/or the tube inner grip 34 against the top end cap 40 an additional incremental amount, thereby causing pressure against the roll of wrapping material 22 an additional incremental amount. Fine adjust tensioning wheel 38 can be threaded on the tube handle 30 to tighten and loosen the tension of the roll of wrapping material 22. This can be adjusted on the fly as the roll of wrapping material 22 necessitates more or less tension.

A lower end 56 of fine adjust tensioning wheel 38 can be structured to cooperate with an upper end 58 of tensioning wheel 44, which is shown in FIG. 8. For example, lower end 56 can be a female structure that fits over upper end 58, which can be a male structure, a certain distance. Fine adjust tensioning wheel 38 can be rotated, causing the lower end 56 of fine adjust tensioning wheel 38 to contact the upper end 58 of tensioning wheel 44, thus pushing tensioning wheel 44 against tube inner grip 34 and/or grip halves 32, thereby pushing tube inner grip 34 and/or grip halves 32 against top end cap 40, so as to create additional tension on the roll of wrapping material 22. The threading of fine adjust tensioning wheel 38 can be different than the threading of tensioning wheel 44 so that the rotation of fine adjust tensioning wheel 38 results in less axial movement of fine adjust tensioning wheel 38 along tube handle 30 than an equal rotation of tensioning wheel 44, creating the fine versus gross adjustment capabilities of fine adjustment tensioning wheel 38 versus tensioning wheel 44.

FIG. 8 are a top view, side view, bottom view, cross-sectional left side view, and cross-sectional right side view of a tensioning wheel 44 of the present invention. FIG. 8A is a top view of a tensioning wheel 44 of the present invention. FIG. 8B is a side view of the tensioning wheel 44 of FIG. 8A. FIG. 8C is a bottom view of the tensioning wheel 44 of FIG. 8A. FIG. 8D is a cross-sectional left side view of the tensioning wheel 44 of FIG. 8A along section line B-B of FIG. 8A. FIG. 8E is a cross-sectional right side view of the tensioning wheel 44 of FIG. 8A along section line A-A of FIG. 8A. Tensioning wheel 44 is a generally cylindrical structure located on tube handle 30 and is generally coaxial with tube handle 30.

Tensioning wheel 44 can be located on tube handle 30 above tube inner grip 34, that is, between tube inner grip 34 and handle handle grip 16, but contacting tube inner grip 34 and not necessarily touching handle grip 16. Tensioning wheel 44 can be used to move the tensioning system assembly 18 against the roll of wrapping material 22 a relatively gross amount. The tensioning wheel 44 can be turned on the device 10 and is threaded on the tube handle 30 so that upon turning, tensioning wheel 44 tightens and loosens the tension of the roll of wrapping material 22. For example, the tensioning wheel 44 can act upon the tube inner grip 34 and/or the grip halves 32 and/or the top end cap 40 to force the top end cap 40 against the roll of wrapping material 22, thus increasing friction on the roll of wrapping material 22 between the top end cap 40 and the roll of wrapping material 22. For another example, the top end cap 40 can fit within the core of the roll of wrapping material 22, and the tensioning wheel 44 can act upon the tube inner grip 34 and/or the grip halves 32 and/or the top end cap 40 to force the roll of wrapping material 22 against the bottom end cap 26, thus increasing friction on the roll of wrapping material 22 between the bottom end cap 26 and the roll of wrapping material 22. This tension (friction/drag/pressure) can be adjusted on the fly as the roll of wrapping material 22 necessitates more or less tension.

An upper end 58 of tensioning wheel 44 can be structured to cooperate with a lower end 56 of fine adjust tensioning wheel 38, which is shown in FIG. 7. For example, upper end 58 can be a male structure that fits within lower end 56, which can be a female structure, a certain distance. As fine adjust tensioning wheel 44 is rotated, the lower end 56 of fine adjust tensioning wheel 38 contacts the upper end 58 of tensioning wheel 44, thus pushing tensioning wheel 44 against tube inner grip 34 and/or grip halves 32, thereby pushing tube inner grip 34 and/or grip halves 32 against top end cap 40, so as to create additional tension on the roll of wrapping material 22. The threading of tensioning wheel 44 can be different than the threading of fine adjust tensioning wheel 38 so that the rotation of tensioning wheel 44 results in more axial movement of tensioning wheel 44 along tube handle 30 than an equal rotation of fine adjust tensioning wheel 38, creating the gross versus fine adjustment capabilities of tensioning wheel 44 versus fine adjust tensioning wheel 38.

A lower end 60 of tensioning wheel 44 can be structured to cooperate with an upper end 62 of grip halves 32, which is shown in FIG. 7, and/or an upper end 64 of tube inner grip 34, which is shown in FIG. 6. For example, lower end 60 can be a female structure that fits over upper end 62, 64, which can be a male structure, a certain distance. As tensioning wheel 44 is rotated, the lower end 60 of tensioning wheel 44 contacts the upper end 62 of grip halves 32 and/or the upper end 64 of inner tube sleeve 34, thus pushing tube inner grip 34 and/or grip halves 32 against top end cap 40, so as to create tension on the roll of wrapping material 22.

Tube handle 30 can have threading to cooperate with either or both of fine adjustment tensioning wheel 38 and tensioning wheel 44. Alternatively, either or both of fine adjustment tensioning wheel 38 and tensioning wheel 44 can have friction threading. Such friction threading can cooperate with the surface of tube handle 30 to allow the movement of fine adjust tensioning wheel 38 and/or tensioning wheel 44 along tube handle 30 when fine adjust tensioning wheel 38 and/or tensioning wheel 44 are rotated.

FIG. 9 are a top view, side view, cross-sectional side view, bottom view, left end view, and right end view of a grip half 32 of the present invention. FIG. 9A is a top view of a grip handle of the present invention. FIG. 9B is a side view of the grip handle of FIG. 9A. FIG. 9C is a cross-sectional side view of the grip handle of FIG. 9A along section line A-A of FIG. 9A. FIG. 9D is a bottom view of the grip handle of FIG. 9A. FIG. 9E is a left end view of the grip handle of FIG. 9A. FIG. 9F is a right end view of the grip handle of FIG. 9A. Two of grip halves 32 form a sliding grip handle 32A.

Grip halves 32 are generally half-cylindrical or elongated arc shaped in structure. Two grip halves combined, generally by screws, pins, or other combining means 66, form a sliding grip handle 32A. A first or upper end 62 of sliding grip handle 32A can be structured to cooperate with a lower end 60 of tensioning wheel 44, which is shown in FIG. 8. For example, upper end 62 can be a male structure that fits over lower end 60, which can be a female structure, a certain distance. As tensioning wheel 44 is rotated, the lower end 60 of tensioning wheel 44 can contact the upper end 62 of sliding grip handle 32A, thus pushing sliding grip handle 32A against top end cap 40, so as to create tension on the roll of wrapping material 22.

A second or lower end 68 of sliding grip handle 32A is generally flat and can contact top end cap 40. A bearing 46 can be inserted between sliding grip handle 32A and top end cap 40 to help reduce friction and/or wear between sliding grip handle 32A (and tube inner grip 34) and top end cap 40. Bearing 46 can be brass, plastic, polymer, or any other suitable bearing material.

The outer surface of grip half 32 preferably is smooth and/or contoured to provide a comfortable or secure gripping surface for the user's hands while operating the device 10. Thus, grip half 32 preferably is at least as long as a typical user's hand is wide to allow for such a grip. Specifically, as the device 10 is operated, the user typically holds the handle grip 16 in one hand and the sliding grip handle 32A in the other hand.

The inner surface of grip half 32 comprises guide tab 50. Guide tab 50 is located along the inner surface of grip half 32 at a position such that guide tab 50 can cooperate with and extend through guide slot 40 of inner tube sleeve 34 and guide slot 52 of tube handle 30. Thus, when grip half 32 or sliding grip handle 32A is place on or about tube inner grip 34, guide tab 50 extends through guide slots 40, 52 so as to assist in guiding and controlling tube inner grip 34 and sliding grip handle 32A.

As mentioned, two grip halves 32 can be clamped over tube inner grip 34 to form sliding grip handle 32A to enhance the comfort of the user in holding and operating the device 10. Grip halves 32 also can be part of the tensioning system assembly 18. For example, upon rotation of tensioning wheel 44, tensioning wheel 44 also can force grip halves 32 against top end cap 40, thus forcing top end cap 40 against the roll of wrapping material 22, thus increasing the tension on the roll of wrapping material 22.

FIG. 10 are a top view, side view, bottom view, cross-sectional left side view, and cross-sectional right side view of a roll top end cap 40 of the present invention. FIG. 10A is a top view of a roll top end cap of the present invention. FIG. 10B is a side view of the roll top end cap of FIG. 10A. FIG. 10C is a bottom view of the roll top end cap of FIG. 10A. FIG. 10D is a cross-sectional left side view of the roll top end cap of FIG. 10A along section line B-B of FIG. 10C. FIG. 10E is a cross-sectional right side view of the roll top end cap of FIG. 10A along section line A-A of FIG. 10C. Top end cap 40 is a generally cylindrical structure located on tube handle 30 and is generally coaxial with tube handle 30.

Top end cap 40 preferably is structured to cooperate on one end with tube inner grip 34 and/or sliding grip handle 32A and on another end with the first end of the roll of wrapping material 22. An upper end 72 of top end cap 40 can be flat 78 or have an annular indentation 76 for containing bearing 46. Lower end 64 of tube inner grip and/or lower end 68 of grip half 32 can contact upper end 72 of top end cap 40, and preferably contact bearing 46.

A lower end 70 of top end cap 40 can be structured to contact or fit within the core tube of the roll of wrapping material 22 so as to be able to increase the tension on, via friction for example, the roll of wrapping material 22, thus causing it to spin more slowly or with greater difficulty (higher tension) or allowing it to spin more quickly or with less difficulty (lower tension) as desired by the user. Lower end 70 may have ribs 74 for centering lower end 70 within the core tube and/or for providing more friction between top end cap 40 and the inner surface of core tube.

The tensioning system assembly 18 is retained on the tube handle 30 by a retaining means, such as nut 42. Nut 42 can be threaded onto tube handle 30, or attached by other means such as, for example, adhesives, pins, clips, staples, or other known devices.

FIG. 11 are a top view, side view, bottom view, cross-sectional left side view, cross-sectional right side view, and right side view of a roll bottom end cap 26 of the present invention. FIG. 11A is a top view of a roll bottom end cap 26 of the present invention. FIG. 11B is a side view of the roll bottom end cap 26 of FIG. 11A. FIG. 11C is a bottom view of the roll bottom end cap 26 of FIG. 11A. FIG. 11D is a cross-sectional left side view of the roll bottom end cap 26 of FIG. 11A along section line B-B of FIG. 11A. FIG. 11E is a cross-sectional right side view of the roll bottom end cap 26 of FIG. 11A along section line A-A of FIG. 11A. FIG. 11F is a cross-sectional right side view of a roll bottom end cap 25 of FIG. 11A along section line C-C of FIG. 11A.

Bottom end cap 26 is releasably secured to tube extension 12 to as to hold the roll of wrapping material 22 on the tube extension 12. Bottom end cap 26 is a generally disk or saucer shaped structure releasably attachable coaxially to the tube extension 12. Preferably, bottom end cap 26 has a central bulge or protrusion 80 that can fit within or cooperate with the core tube of the roll of wrapping material 22 so as to hold the roll of wrapping material 22 on the tube extension 12 in a more secure and centered (stable) manner while the roll of wrapping material 22 is spinning or rotating while in use. For example, the inner diameter of the core of the roll of wrapping material 22 may be larger than the outer diameter of the tube extension 12 such that the roll of wrapping material 22 may wobble on the tube extension 12 while spinning. The bulge or protrusion 80 can help alleviate this wobbling. A portion of bulge or protrusion 80 also may fit within the interior of tube extension 12 if tube extension 12 is a hollow tube or rod.

The central bulge or protrusion 80 extends from a flat or preferably curved or sloped main body 82. While bulge or protrusion 80 fits within and or contacts the interior of the core tube, the main body 82 supports, holds, or contacts the lineal edge of the core tube or the wrapping material 22 or both. The tensioning system assembly 18 can force the roll of wrapping material 22 against the bottom end cap 26 to frictionally increase tension on the roll of wrapping material 22 so as to prevent the roll of wrapping material 22 from spinning faster than a desired speed. Alternatively, having a curved or angled structure can help to minimize contact and friction between the bottom end cap 26 and the wrapping material 22, thereby allowing the roll of wrapping material to spin more easily on the device 10.

The center of bulge or protrusion 80 can comprise a hole or slot 84 through which an end 86 of tube extension 12 (or a separate attachment rod attached to the end of tube extension 12 if tube extension 12 is a hollow rod or tube) can extend, as described in more detail in connection with FIGS. 16 and 17. Bottom end cap 26 is releasably secured to tube extension 12 by roll quarter turn knob 28, as described in connection with FIG. 12. Bottom end cap 26 preferably contacts a second end of the roll of wrapping material 22 and cooperates with the top end cap 40 to maintain the roll of wrapping material 22 on the device 10 and at a desired tension on the device 10.

FIG. 12 are a top view, side view, bottom view, left side view, cross-sectional right side view, and cross-sectional front view of a locking knob in the form of a roll quarter turn knob 28 of the present invention. FIG. 12A is a top view of a roll quarter turn knob 28 of the present invention. FIG. 12B is a side view of the roll quarter turn knob 28 of FIG. 12A. FIG. 12C is a bottom view of the roll quarter turn knob 28 of FIG. 12A. FIG. 12D is a left side view of the roll quarter turn knob 28 of FIG. 12A. FIG. 12E is a cross-sectional right side view of the roll quarter turn knob 28 of FIG. 12A along section line A-A of FIG. 12C. FIG. 12F is a cross-sectional front view of the roll quarter turn knob 28 of FIG. 12A along section line B-B of FIG. 12 C. Quarter turn knob 28 is a generally cylindrical structure located on tube extension 12 and is generally coaxial with tube extension 12.

Quarter turn knob 28 is part of a bottom loading mechanism for the present invention for replacing rolls of wrapping material 22. The bottom loading mechanism comprises quarter turn knob 28, bottom end cap 26, a lower end of tube extension 12, end 86 of tube extension 12 or a separate an attachment rod, and pin 94. The device 10 has a quarter turn knob 28 on the bottom that releases with a quarter turn off the end 86. This releases the tension against the roll of wrapping material 22 and exposes the bottom of the device 10 so as to release the empty roll of wrapping material 22 and allowing the user to replace the empty roll of wrapping material 22 with a new roll of wrapping material 22. After setting the new roll of wrapping material 22 in place, the bottom end cap 26 is replaced and secured with the quarter turn knob 28 locking the device 10 back together and the device 10 is now ready to use again. The quarter turn knob 28 preferably is made of durable molded plastic that allows for constant use and abuse as it not only locks and unlocks the rolls of wrapping paper 22, it also functions as the guide that rolls on the floor as the user begins wrapping a pallet from the bottom.

Quarter turn knob 28 comprises a generally cylindrical wall, a closed foot 88 on a lower end and an opening 90 on an upper end, the opening leading to a generally cylindrical and hollow interior 92. Closed foot 88 functions as the guide that rolls on the floor as the user begins wrapping a pallet. Opening 90 allows for attaching the quarter turn knob 88 to the end 86 of tube extension 12.

Figure 12A:
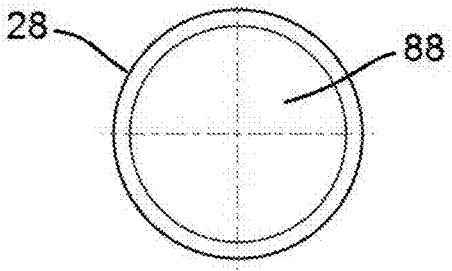
FIG. 12A is a top view of a roll quarter turn knob of the present invention.
Figure 12D:
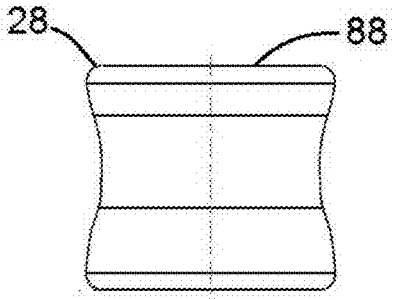
FIG. 12D is a left side view of the roll quarter turn knob of FIG. 12A.
Figure 12B:
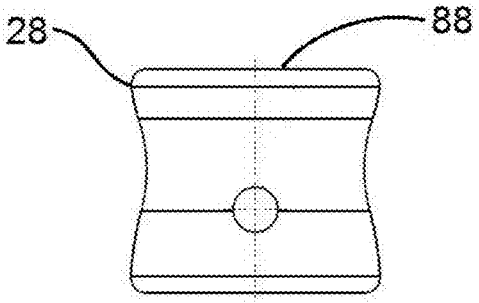
FIG. 12B is a side view of the roll quarter turn knob of FIG. 12A.
Figure 12E:
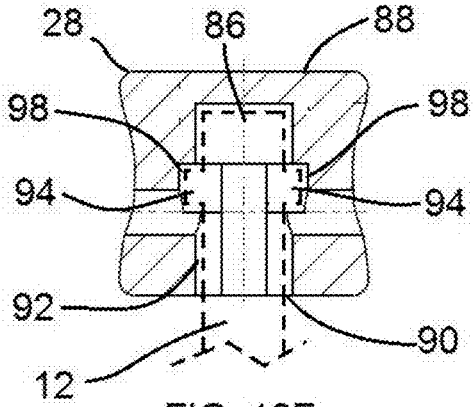
FIG. 12E is a cross-sectional right side view of the roll quarter turn knob of FIG. 12A along section line A-A of FIG.
Figure 12C:
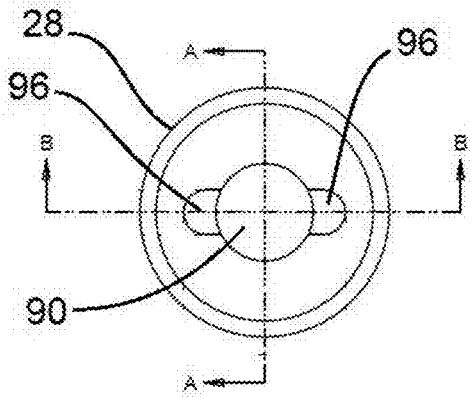
FIG. 12C is a bottom view of the roll quarter turn knob of FIG. 12A.
Figure 12F:
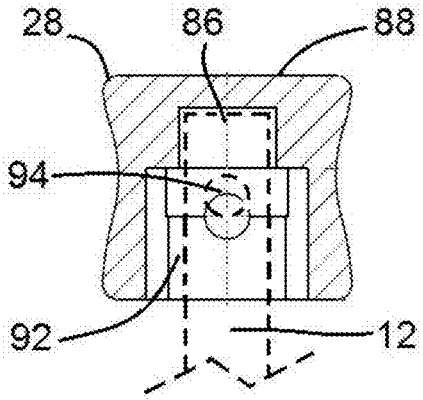
FIG. 12F is a cross-sectional front view of the roll quarter turn knob of FIG. 12A along section line B-B of FIG. 12C.
Figure 16:
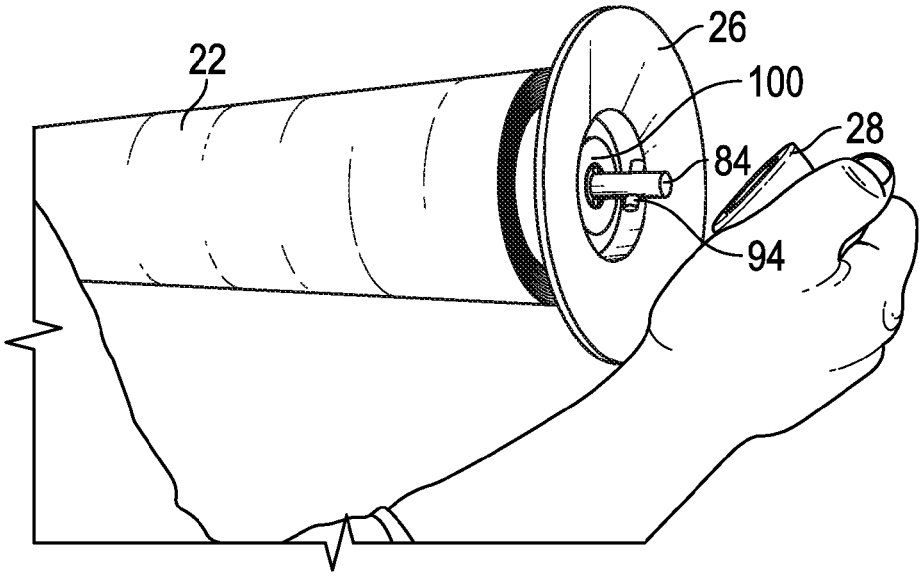
FIG. 16 is a first perspective view of the end cap of the present invention being removed for replacement of a roll of wrapping material and/or the replacement of the end cap.
Figure 17:
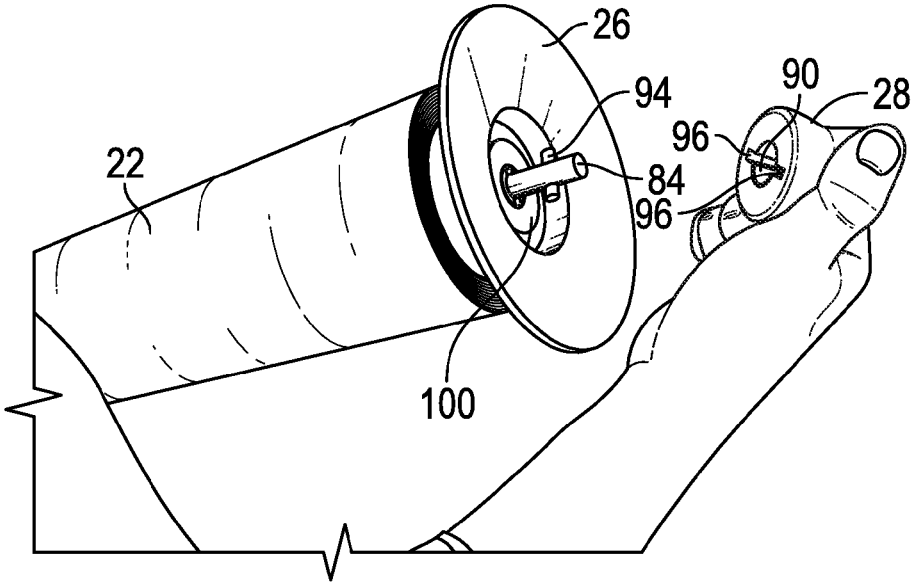
FIG. 17 is a second perspective view of the end cap of the present invention being removed for replacement of a roll of wrapping material and/or the replacement of the end cap.

In a preferred embodiment as shown in FIGS. 16 and 17, the end 86 of tube extension 12 is either T-shaped or has a pin 94 through a hole through tube extension 12, the hole being proximal to end 86 and perpendicular to the central axis of tube extension 12. Opening 90 in this embodiment is circular to accommodate tube extension 12 with opposing partial circles 96 for accommodating pin 94. Within hollow interior 92, side channels 98 extend normal to the main cylindrical portion of hollow interior 92 in a generally arc-like configuration, each arc-like configuration covering 90 degrees. Thus, when end 86 of tube extension 12 is inserted into hollow interior 92, ends of pin 94 initially slide through partial circles 96. As shown in FIG. 12F, when end 86 is inserted the appropriate distance within hollow interior 92, ends of pin 94 align with side channels 98 so that when quarter turn knob 28 is rotated a quarter of a turn (90 degrees), as shown in FIG. 12E, each end of pin 94 is rotated into a respective side channel 98 so as to lock quarter turn knob 28 onto end 86. In FIGS. 12E and 12F, end 86 of extension tube 12 and pin 94 are shown in ghost lines. To unlock quarter turn knob 28, quarter turn knob 28 is rotated 90 degrees in the opposite direction.

Figure 13:
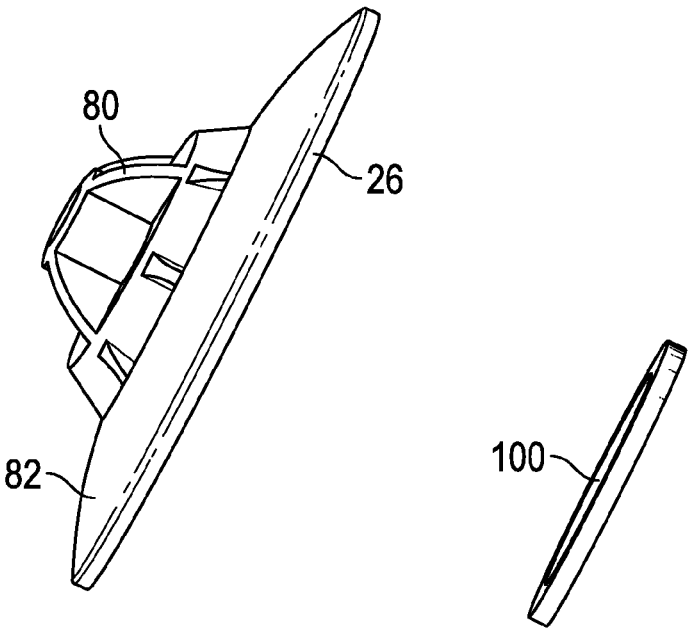
FIG. 13 is a side perspective view of a bottom end cap assembly of the present invention.

FIG. 13 is a side perspective view of a bottom end cap 26 assembly of the present invention showing a washer 100 that is placed between the bottom end cap 26 and the quarter turn knob 28.

Figure 14:
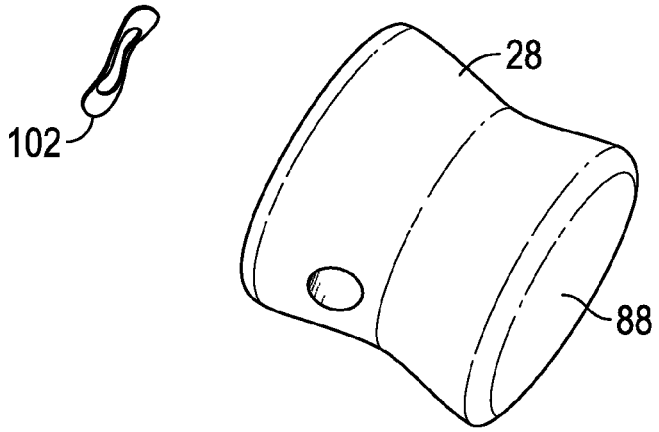
FIG. 14 is a side perspective view of a quarter turn assembly of the present invention.

FIG. 14 is a side perspective view of a quarter turn knob 28 assembly of the present invention showing a clip 102 that can be used to assist in securing quarter turn knob 28 onto end 86 of tube extension 12.

Figure 15:
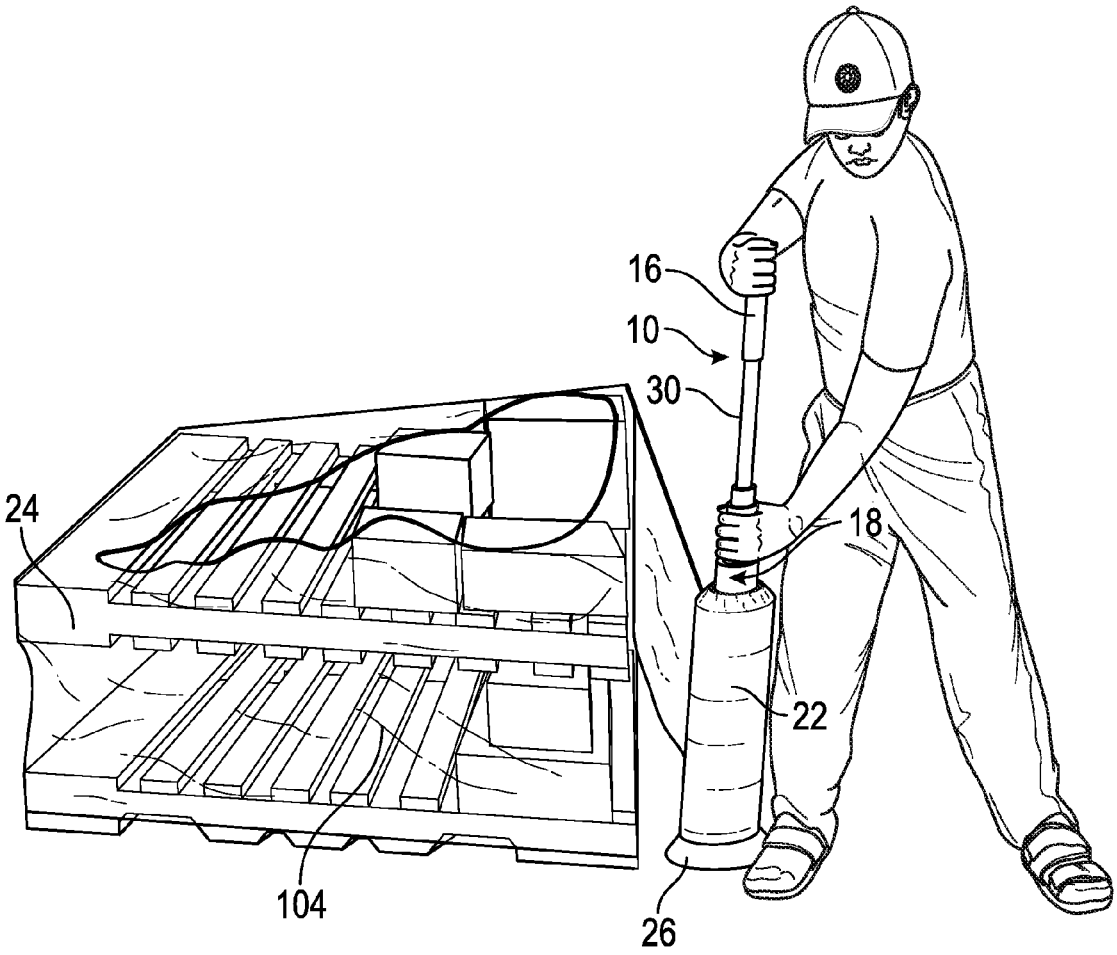
FIG. 15 illustrates how the present invention can be used to wrap a pallet of goods in a wrapping material.

FIG. 15 illustrates how the present invention can be used to wrap a pallet of goods in a wrapping material 22. In use, the user grasps the device 10 by the handle grip 16 (on top) and the sliding grip handle 32A (generally centrally), with the roll of wrapping 22 below the sliding grip handle 32A and above the end cap assembly 20. It should be noted that the device 10 can be used in any orientation, such as horizontally, or with the handle grip 16 below the end cap assembly 20. However, for ease of disclosure, use in the vertical position with the handle grip 16 generally above the sliding grip handle 32A and the end cap assembly 20 will be explained.

The wrapping material 22, in this example stretch wrap 104, is placed against the item to be wrapped, in this example goods on a pallet 24. The device 10 then is walked around the pallet 24 thus unwinding the stretch wrap 104 around the goods on the pallet 24. In FIG. 15, the device 10 already has been walked around the pallet 24 at least once, and stretch wrap 104 can be seen already wrapping the goods on the pallet 24. Once the item to be wrapped is wrapped a sufficient amount, the wrapping material 22 is cut. If the roll of wrapping material 22 runs out of wrapping material 22, the empty roll of wrapping material 22 can be removed from the device 10 and replaced with a new roll of wrapping material 22.

To secure the roll of wrapping material 22 onto the device 10, sliding grip handle 32A and/or tube inner grip 34 is moved downwards against the roll of wrapping material 22 forcing the roll of wrapping material 22 against the bottom end cap 26. Tensioning wheel 44 and fine adjust tensioning wheel 38 are rotated to secure the roll of wrapping material 22 against the bottom end cap 26 at a desired tension, resulting in the roll of wrapping material 22 being able to rotate at a desired rate. The device 10 may rest on the ground on the foot 88 of quarter turn knob 28 even as the user moves the device 10 around the goods to be wrapped.

FIG. 16 is a first perspective view of the end cap assembly 20 of the present invention, with the quarter turn knob 28 being removed for replacement of a roll of wrapping material 22 and/or the replacement of the end cap 28. End 86 of tube extension 12 can be seen, with the ends of pin 94 extending normal to the central axis of tube extension 12. Bottom end cap 26 is shown on the device 10 along with washer 100.

FIG. 17 is a second perspective view of the end cap assembly 20 of the present invention, with the quarter turn knob 28 being removed for replacement of a roll of wrapping material 22 and/or the replacement of the end cap 28. Opening 90 with partial circles 96 are shown. End 84 is inserted into opening 90, and the opposing ends of pin 94 are inserted into the partial circles 96 when attaching quarter turn knob 28 to end 86 of tube extension 12.

Figure 18:
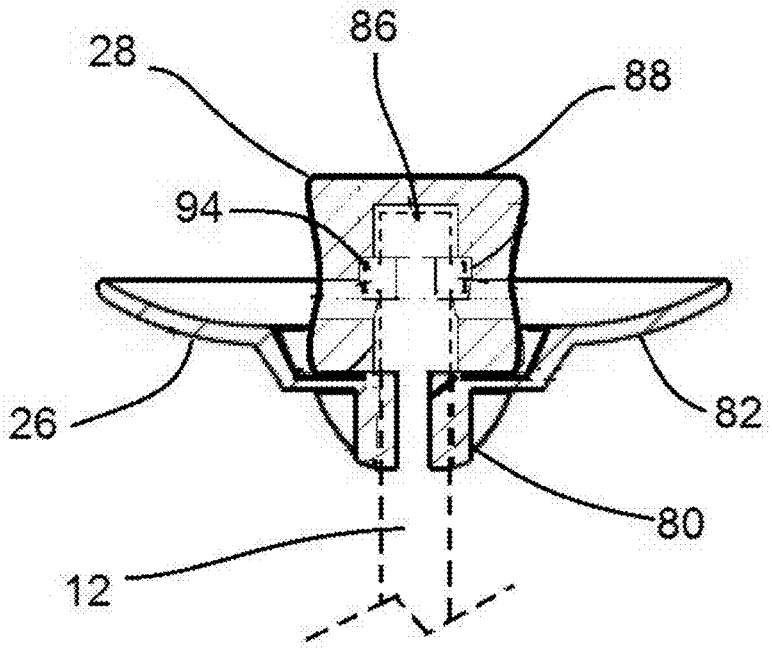
FIG. 18 is a cross-sectional view of a combined roll bottom end cap and roll quarter turn knob of the present invention.

FIG. 18 is a cross-sectional view of a combined roll bottom end cap 26 and roll quarter turn knob 28 of the present invention. In this alternative embodiment, bottom end cap 26 and quarter turn knob 28 are combined as a single structure.

Each part of the device 10 can be made out of suitable known materials, such as plastics, metals, composites, ceramics, and the like. Combinations of materials can be used for a single part if stronger or weaker materials are suitable.

The foregoing description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

What is claimed is:

1. A device for holding and handling a roll of wrapping material comprising:

a handle assembly;

a tensioning system assembly located on the handle assembly, the tensioning system assembly comprising a tensioning means that is movable against and cooperates with a first end of the roll of wrapping material;

a tube extension adjustably connected to the handle assembly;

a bottom loading assembly located on the tube extension, the bottom loading assembly comprising a removable bottom end cap cooperating with a second end of the roll of wrapping material, wherein the bottom end cap releasably secures the roll of wrapping material on the tube extension; and a locking knob for retaining the bottom end cap on the tube extension, wherein the locking knob turns one quarter of a revolution to lock the locking knob on the tube extension thereby retaining the bottom end cap on the tube extension, wherein the tensioning means comprises threading and is threaded on the handle assembly whereby the tensioning means is rotatably adjustable while the device is in use applying wrapping material to an item to be wrapped so as to tighten or loosen the roll of wrapping material on the device between the tensioning system assembly and the bottom loading assembly so that the roll of wrapping material spins slower or faster, respectively.

2. The device as claimed in claim 1, wherein the tensioning system assembly further comprises a sliding grip handle and a top end cap located between the tensioning means and the first end of the roll of wrapping material, the sliding grip handle being movable against the top end cap, whereby the top end cap is forced against the first end of the roll of wrapping material thereby forcing the roll of wrapping material against the bottom end cap.

3. The device as claimed in claim 2, wherein the tensioning means is rotatably attached to the handle assembly, whereby by turning the tensioning means, the tensioning means presses against the sliding grip handle, forcing the sliding grip handle against the top end cap, which in turn is in contact with the first end of the roll of wrapping material, thereby causing pressure against the roll of wrapping material.

4. The device as claimed in claim 2, wherein the top end cap fits snugly inside a tube holding the wrapping material.

5. The device as claimed in claim 3, wherein the tensioning system assembly further comprises a fine adjust tensioning means rotatably attached to the handle assembly, whereby by turning the fine adjust tensioning means, the fine adjust tensioning means presses against the tensioning means, thereby pressing the tensioning means against the sliding grip handle an additional incremental amount, thereby forcing the sliding grip handle against the top end cap an additional incremental amount, thereby causing pressure against the roll of wrapping material an additional incremental amount.

6. The device as claimed in claim 2, wherein the tensioning system assembly further comprises a tube inner grip located between the sliding grip handle and the handle assembly, the tube inner grip being generally coextensive with the sliding grip handle along the handle assembly.

7. The device as claimed in claim 2, wherein the sliding grip handle comprises two grip halves.

8. The device according to claim 3, wherein the tensioning system assembly further comprises a bearing between the sliding grip handle and the top end cap to help alleviate friction between the sliding grip handle and the top end cap.

9. The device as claimed in claim 3, wherein handle assembly further comprises a tube handle that comprises a guide slot that cooperates with a guide tab on sliding grip handle to help control and guide sliding grip handle.

10. The device as claimed in claim 3, wherein handle assembly further comprises a tube handle that comprises an adjustment means that allows the tube extension to be releasably and adjustably secured to the tube handle.

11. The device as claimed in claim 10, wherein the tube extension is a rod on which the roll of wrapping material is rotatably placed and on which the end cap is releasably attached, the tube extension having an outer diameter that can slidably fit within an interior of the tube handle, whereby the tube extension cooperates in a telescoping relationship with the tube handle so as to fit various sized rolls of the wrapping material.

12. The device as claimed in claim 1, wherein the locking knob comprises a generally cylindrical wall, a closed foot on a lower end of the locking knob, and an opening on an upper end of the locking knob, the opening leading to a hollow interior, wherein the opening allows for attaching the locking knob to an end of the tube extension.

13. The device as claimed in claim 12, wherein:

the end of tube extension comprises pins extending normal to the tube extension in a T-shape;

the opening and hollow interior comprise a main cylindrical portion with opposing partial circles extending normal to the main cylindrical portion, the main cylindrical portion for accommodating the tube extension and the opposing partial circles for accommodating the pins; and the hollow interior further comprises side channels extending normal to the main cylindrical portion of hollow interior in a generally arc-like configuration, whereby when the end of the tube extension is inserted into the hollow interior, the pins initially slide through the partial circles until the pins align with the side channels so that when the locking knob is rotated, the pins are rotated into a respective one of the side channels so as to lock the locking knob onto the end of the tube extension.

14. The device as claimed in claim 12, wherein the bottom end cap is a disk or saucer shaped structure releasably attachable coaxially to the tube extension.

15. The device as claimed in claim 14, wherein the bottom end cap comprises a central bulge or protrusion that can fit within or cooperate with the roll of wrapping material so as to hold the roll of wrapping material on the tube extension in a secure and centered manner.

16. The device as claimed in claim 15, wherein the central bulge or protrusion comprises a hole or slot through which the end of tube extension extends.

17. The device as claimed in claim 16, wherein the bottom end cap and the locking knob are a single structure.

18. The device as claimed in claim 12, wherein the foot of the locking knob provides support for the device when the device is placed on a floor while the device is in use applying wrapping material to an item to be wrapped.

* * * * *